US007415222B2

(12) United States Patent
Rieck et al.

(10) Patent No.: US 7,415,222 B2
(45) Date of Patent: Aug. 19, 2008

(54) IMAGE PRODUCING MACHINE HAVING A FOOTPRINT-REDUCING TOWER

(75) Inventors: Kenneth J. Rieck, Victor, NY (US); Murray O. Meetze, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 236 days.

(21) Appl. No.: 11/410,127

(22) Filed: Apr. 24, 2006

(65) Prior Publication Data

US 2006/0188287 A1 Aug. 24, 2006

Related U.S. Application Data

(63) Continuation-in-part of application No. 10/767,603, filed on Jan. 28, 2004, now abandoned.

(51) Int. Cl.
*G03G 15/00* (2006.01)
*G03G 21/20* (2006.01)

(52) U.S. Cl. ..... 399/107; 399/92

(58) Field of Classification Search ..... 399/81, 399/92, 104, 411
See application file for complete search history.

(56) References Cited

U.S. PATENT DOCUMENTS 6,169,863 B1 * 1/2001 Osari et al. ..... 399/82
6,463,230 B1 10/2002 Wargo
6,823,157 B2 11/2004 Foltz
2006/0120746 A1 * 6/2006 Lee et al. ..... 399/90

FOREIGN PATENT DOCUMENTS

JP 06067502 A * 3/1994
JP 11119600 A * 4/1999
WO WO 03069415 A1 * 8/2003

* cited by examiner

*Primary Examiner*—Ryan Gleitz

(57) ABSTRACT

A reduced footprint image producing machine including (a) an image output terminal (IOT) having (i) a moveable imaging member including an imaging surface; (ii) latent imaging devices for forming a latent electrostatic toner image on the imaging surface; (iii) a development unit for developing the latent electrostatic image on the imaging surface into a toner image; (iv) a transfer station for transferring the toner image from the imaging surface onto a toner image carrying sheet; (v) a fusing apparatus for heating and fusing the transferred image onto the toner image carrying sheet; and (b) a footprint-reducing tower mounted on top of the IOT and containing (i) machine electronics and controller assembly, and (ii) machine environment conditioning devices including cleaning and exhaust fans along with portions of associated manifolds, thereby preventing the addition of protrusions to a rear of the IOT, and thus reducing the installed foot print of the machine.

14 Claims, 9 Drawing Sheets

IMAGE PRODUCING MACHINE HAVING A FOOTPRINT-REDUCING TOWER

RELATED APPLICATIONS

This application is a CIP (continuation-In-Part) of commonly assigned application, U.S. utility application. Ser. No. 10/767,603, filed Jan. 28, 2004 now abandoned, by the same inventors, and entitled "Image Producing Machine Having A Footprint-Reducing Tower", published Jul. 28, 2005, Publication No. 20050163528. This application is also related to commonly assigned U.S. design application. Ser. No. 29/198,364, also filed Oct. 28, 2004, by the same inventors.

BACKGROUND AND SUMMARY

This disclosure relates to an image producing machine architecture, and more particularly, concerns such a machine having a footprint-reducing tower module.

A typical image producing machine, for example an electrostatographic machine, includes an Image Output Terminal (IOT) that employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document.

After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface.

After the electrostatic latent image is developed with the toner particles, the toner powder image is transferred to a sheet. Thereafter, the toner image is heated to permanently fuse it to the sheet. An image producing machine of this type can be used to produce black and white as well as color prints or images.

In order to produce a color print, the image producing machine includes a plurality of stations. Each station has a charging device for charging the photoconductive surface, an exposing device for selectively illuminating the charged portions of the photoconductive surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image. The resultant multi-color powder image is subsequently transferred to a sheet. The black and white or transferred multi-color image is then permanently fused to the sheet forming the color print.

A conventional or prior art example of such an Image output Terminal (IOT) portion 129 of a conventional image producing machine 99 is illustrated in FIG. 1A. As illustrated, the IOT of the conventional image producing machine 99 typically therefore includes image forming devices as are well known, and bustles or rear side projections 103, 105 and 107 for housing and enclosing machine drives, machine electronics, and machine environment NOHAD (noise, ozone and dirt) conditioning devices (not shown). In larger conventional machines, a provided user interface device usually is built into the machine IOT or sits on the horizontal real estate of the top cover of the machine taking up valuable work surface area. The machine environment conditioning devices and large controller electronics modules have conventionally been added onto the rear of the IOT in the form of protruding bustles 103, 105, 107 because the height of such an IOT is a concern given the average height of potential operators. Unfortunately, such protrusions or bustles 103, 105, 107 typically tend to give the rear of the machine a complicated appearance, and tend to undesirably add significantly to the size of the installed footprint 101 of the conventional machine 99. Generally, the installed footprint of any office or production environment machine is ordinarily a purchasing consideration, given the prime nature of office real estate space.

Examples of such conventional image producing machines 99 are described in U.S. Pat. No. 6,823,157 in which components contained within the IOT include transfer/detack corona generating devices, pretransfer paper baffles, a photoreceptor cleaner, a charge scorotron, an erase lamp, the photoreceptor (P/R) belt, and noise, ozone, heat and dirt (NOHAD) handling manifolds and filter. Similarly in U.S. Pat. No. 6,463,230 the IOT of the conventional office machine includes a machine frame, operating components within an operating environment inside the frame, and a cooling or a noise, ozone and dirt (NOHAD) system that has at least one air blower or air blower assembly. The NOHAD system disclosed therein is suitable for either removing heat or dirt and dust particles from within the operating environment of the machine which ordinarily requires environmental conditioning such as cooling and/or cleaning.

In accordance with the present disclosure, there is provided an image producing machine that includes (a) an image output terminal (IOT) having (i) a moveable imaging member including an imaging surface; (ii) latent imaging devices for forming a latent electrostatic toner image on the imaging surface of the moveable imaging member; (iii) a development unit for developing the latent electrostatic image on the imaging surface into a toner image; (iv) a transfer station for transferring the toner image from the imaging surface onto a toner image carrying sheet; (v) a fusing apparatus for heating and fusing the transferred image onto the toner image carrying sheet; and (b) a footprint-reducing tower mounted on top of the image output terminal and containing (i) machine electronics and controller, and (ii) machine environment conditioning devices including cleaning and exhaust fans along with portions of associated manifolds, thereby preventing the addition of protrusions to a rear of said IOT, and thus reducing the installed foot print of the machine.

The present disclosure will become apparent from the following description in conjunction with the accompanying drawings, in which.

Figure 1A:
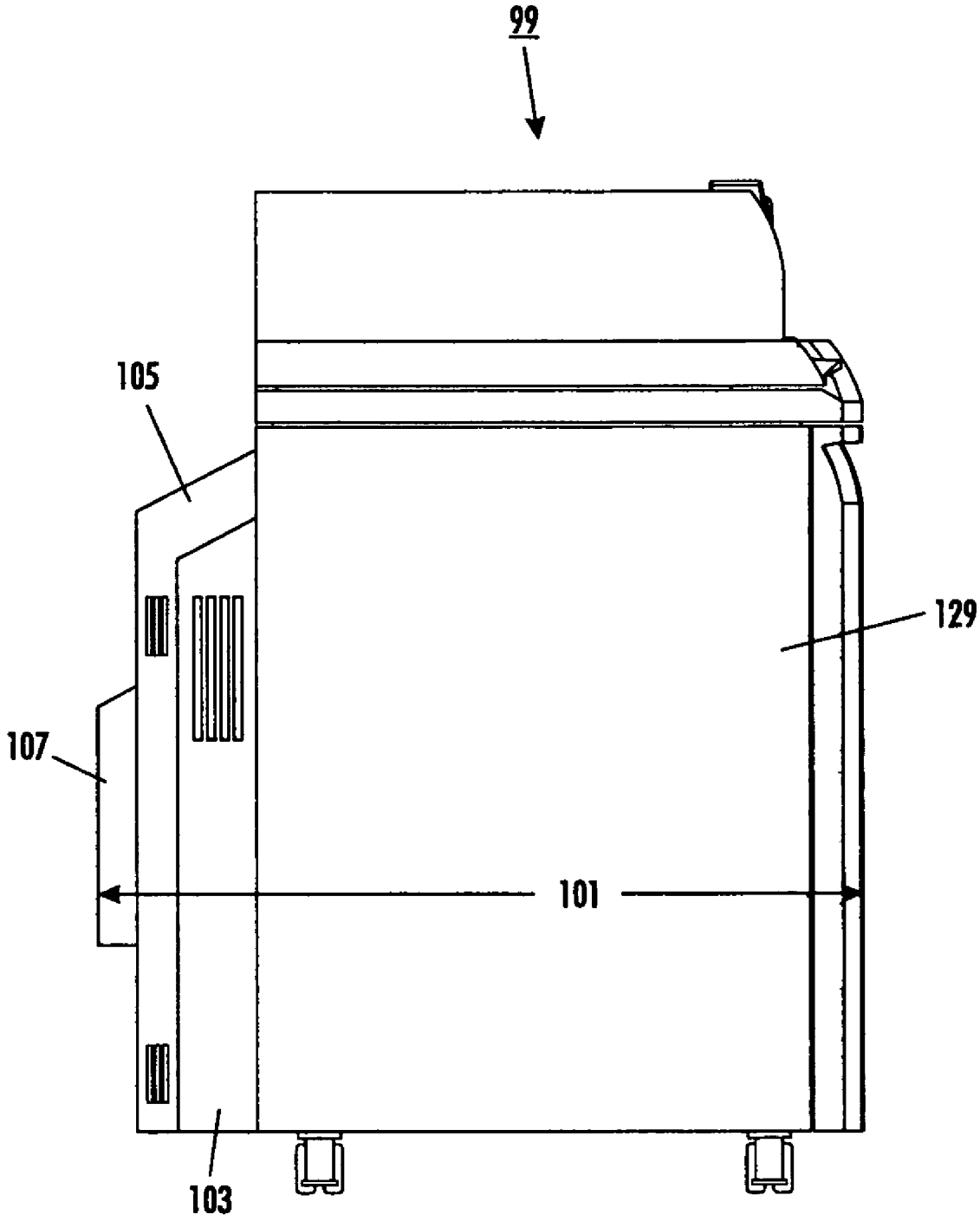
FIG. 1A PRIOR ART
FIG. 1A is a vertical side view of a prior art exemplary image producing machine showing rear side protrusions or bustles.
Figure 1B:
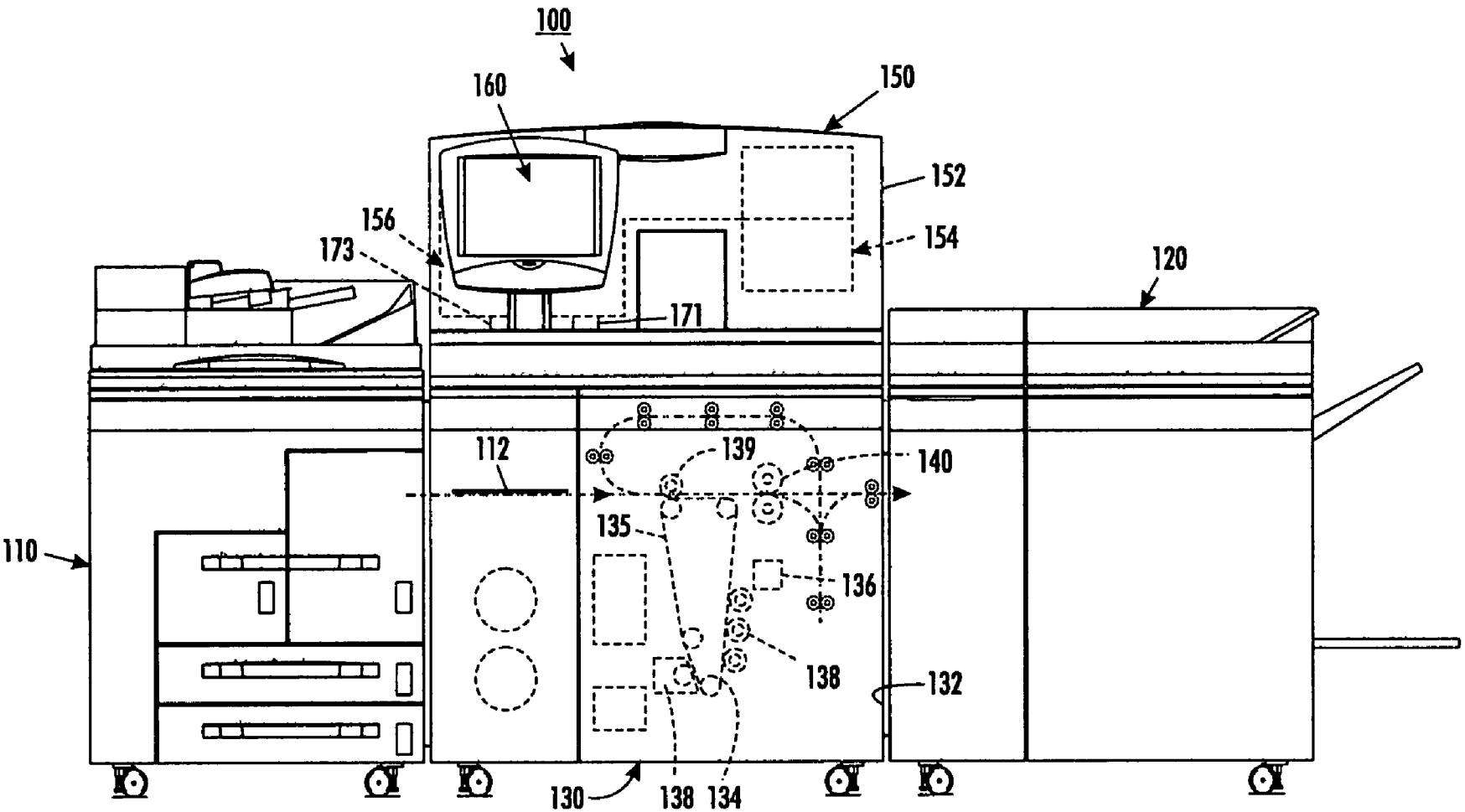
FIG. 1B is a schematic front view of an exemplary image producing machine showing an Image Output terminal (IOT) and the footprint-reducing tower in accordance with the present disclosure.

Referring now to FIG. 1B, in accordance with the present disclosure, an exemplary image producing machine 100 is shown and includes a paper or media holding and supply module 110 for holding and supplying copy sheets, a finishing module 120, and an Image Output terminal (IOT) 130, each of which is a floor standing module on casters as shown. Importantly, the machine 100 also includes a footprint-reducing tower 150 that is mounted on top of the IOT 130 and constitutes a functioning part thereof. As shown, the footprint-reducing tower 150 includes a frame or housing 152 that is mounted on top of the IOT frame 132 which stands on the floor on casters as shown. The tower 150 as mounted extends upwards and is significantly above an expected ordinary height of the floor standing IOT for such a machine as shown.

As further shown, the image output terminal (IOT) 130 includes (i) a moveable imaging member such as a photoreceptor belt 134 including an imaging surface 135; (ii) latent imaging devices or means such as a charger, a scanner and an exposure device 136, as are well known, for forming a latent electrostatic toner image on the imaging surface 135; (iii) development units 138 for developing the latent electrostatic image on the imaging surface into a toner image; (iv) a transfer station 139 for transferring the toner image from the imaging surface onto a toner image carrying sheet 112 from the media supply module 110; (v) a fusing apparatus 140 for heating and fusing the transferred image onto the toner image carrying sheet.

Figure 1C:
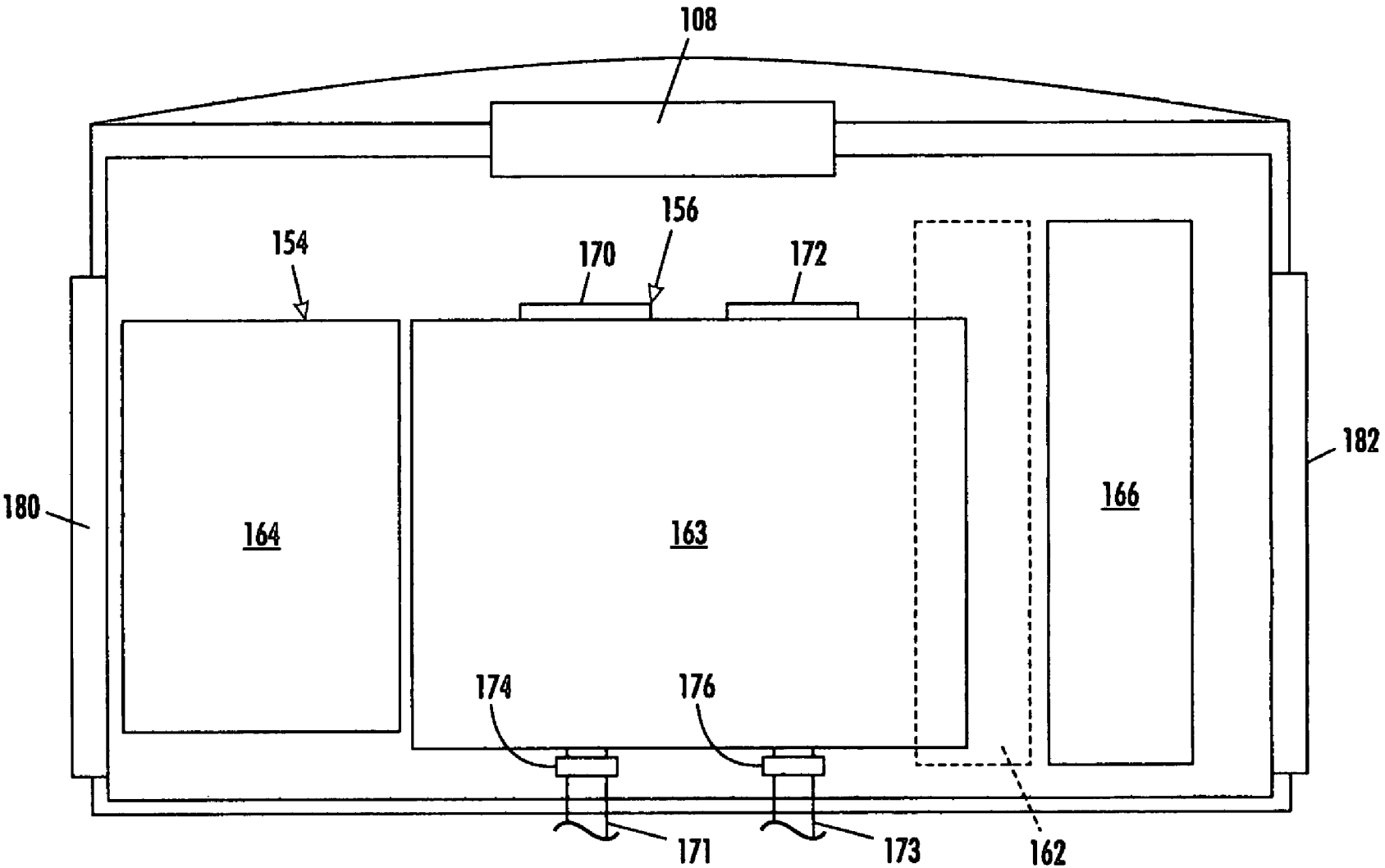
FIG. 1C is a schematic rear view of the footprint-reducing tower of FIG. 1B in accordance with the present disclosure illustrating electronic and NOHAD contents thereof.

Referring now to FIGS. 1A and 1C, the footprint-reducing tower 150 as mounted on top of the IOT 130 includes the tower frame or housing 152 for containing the machine electronics and controller 154 as well as machine environment conditioning devices or NOHAD devices 156. As further shown in FIG. 1C, the machine electronics and controller 154 include a controller hard drive 162, an electronic board card cage 163, a power supply unit 164, and an electrical connected grid 166. The power supply unit 164 provides power distribution to meet the various requirements of the machine control electronics within the card cage 163. The card cage 163 is a contained unit designed to have minimal to no leakage of electronic noise emissions. The electrical connector grid 166 provides a single area where outside devices can be easily plugged into the IOT 130. The hard drive 162 includes means for storing machine software and job information.

The machine environment conditioning devices 156 for example include a pair of cleaning and exhaust fans 170, 172 along with portions of associated conduits or manifolds 171, 173 connecting the fans 170, 172 to dirt pick up locations within the IOT frame or housing 132. The machine environment conditioning devices 156 may also include replaceable filters 174, 176 that are located conveniently within the footprint-reducing tower 150 for access and service. The fans 170, 172 are built into the card cage 163 in order to facilitate a chimney effect cooling of the electronics 154. The footprint-reducing tower 150 also includes a pair of service access doors 180, 182 also conveniently located at a service height, instead of down within the bustles or protrusions 103, 105, 107 (FIG. 1A) to the rear of the IOT 130.

Figure 2:
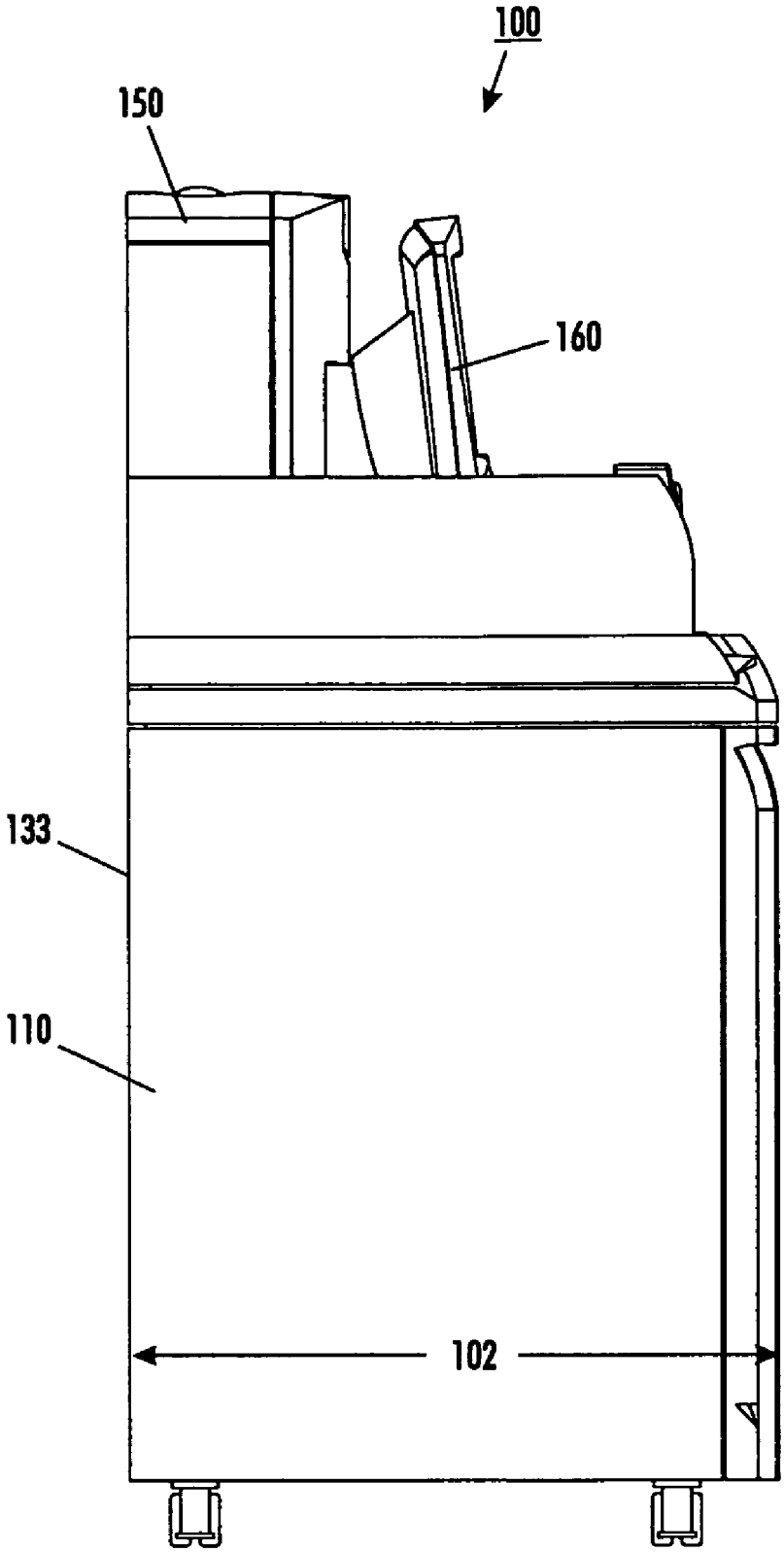
FIG. 2 is a schematic left side view of the exemplary image producing machine of FIG. 1B showing a clean up and down rear with no protrusions.
Figure 3:
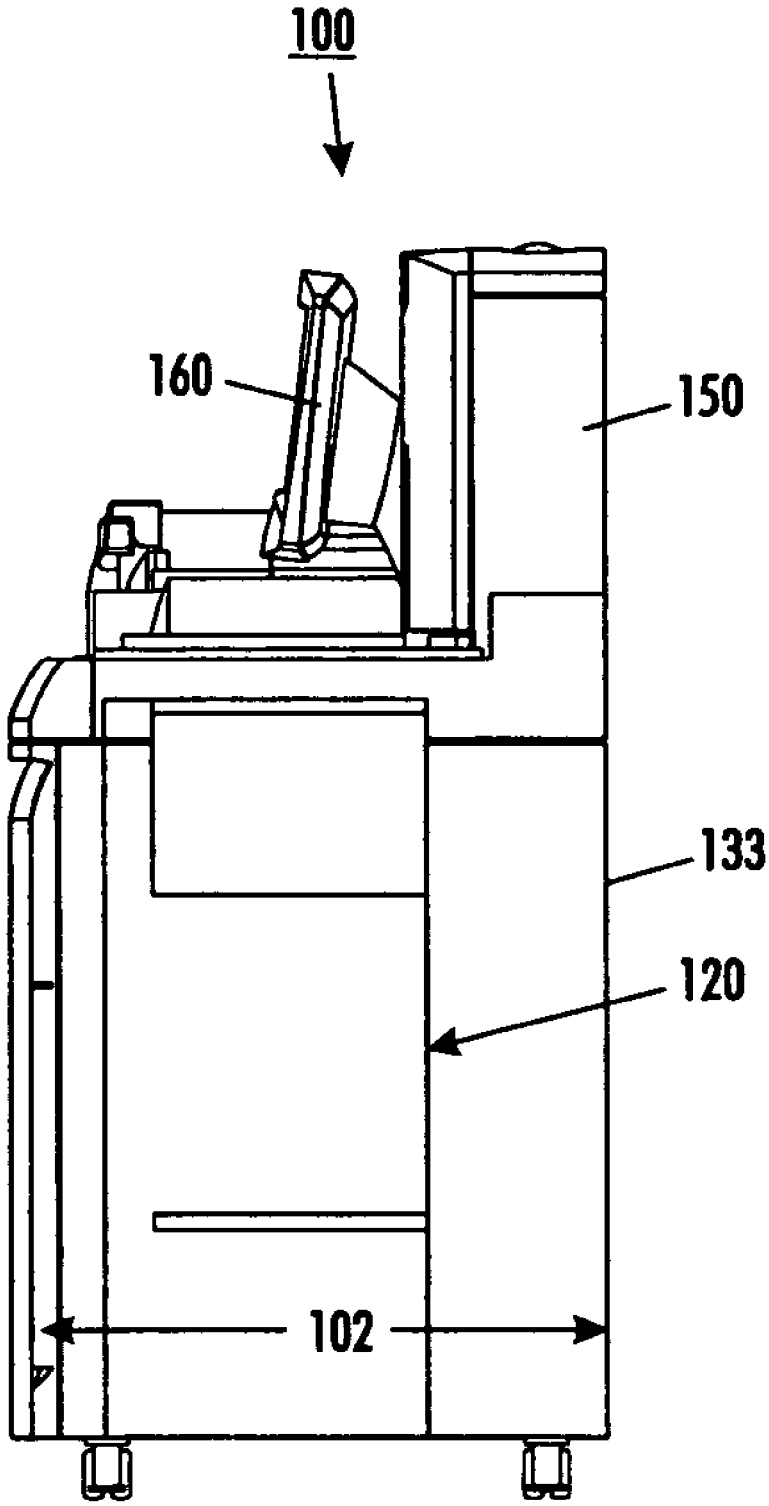
FIG. 3 is a schematic right side view of the exemplary image producing machine of FIG. 1B showing a clean up and down rear with no protrusions.
Figure 4:
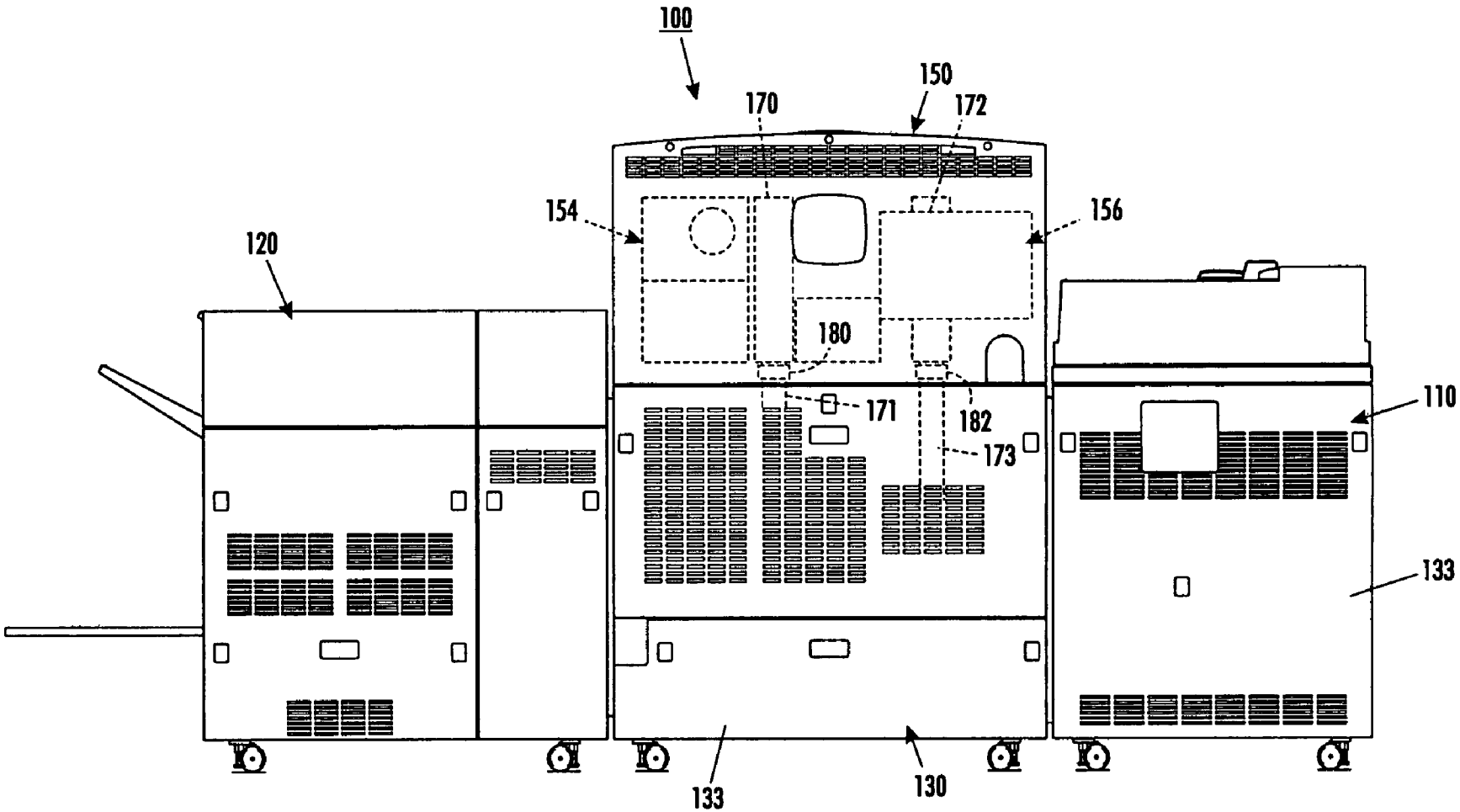
FIG. 4 is a schematic rear view of the exemplary image producing machine of FIG. 1B showing the footprint-reducing tower and the clean up and down rear with no protrusions.

As shown in FIGS. 2-4, by mounting the electronics package and controller 154, for example, to the top and back of the IOT housing 132, the rear or backside 133 of the machine 100 has no protrusions or bustles thereto as is the case in FIG. 1A, thus significantly reducing the installed footprint 102 of the machine 100. The machine 100 also therefore has a simple up and down as well as clean rear or backside, and so can be installed with safe walk areas to the front and rear of it. As a result, the service connections (in the form of the connecting grid 166), are moved to the top of the machine, thus enabling an easier service access by technicians.

Figure 5:
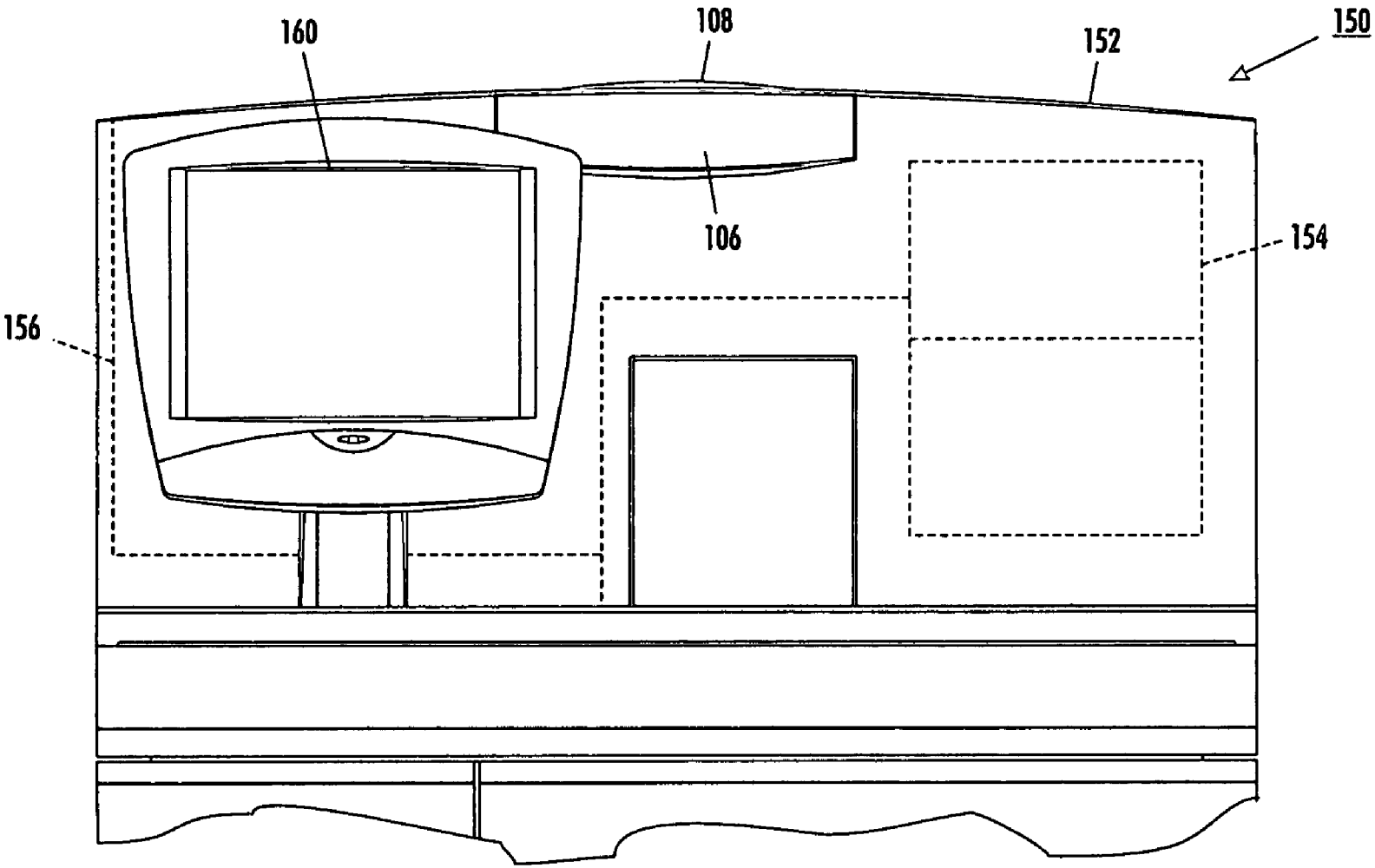
FIG. 5 is a schematic front view of the footprint-reducing tower of the present disclosure including an attached UI device.
Figure 6:
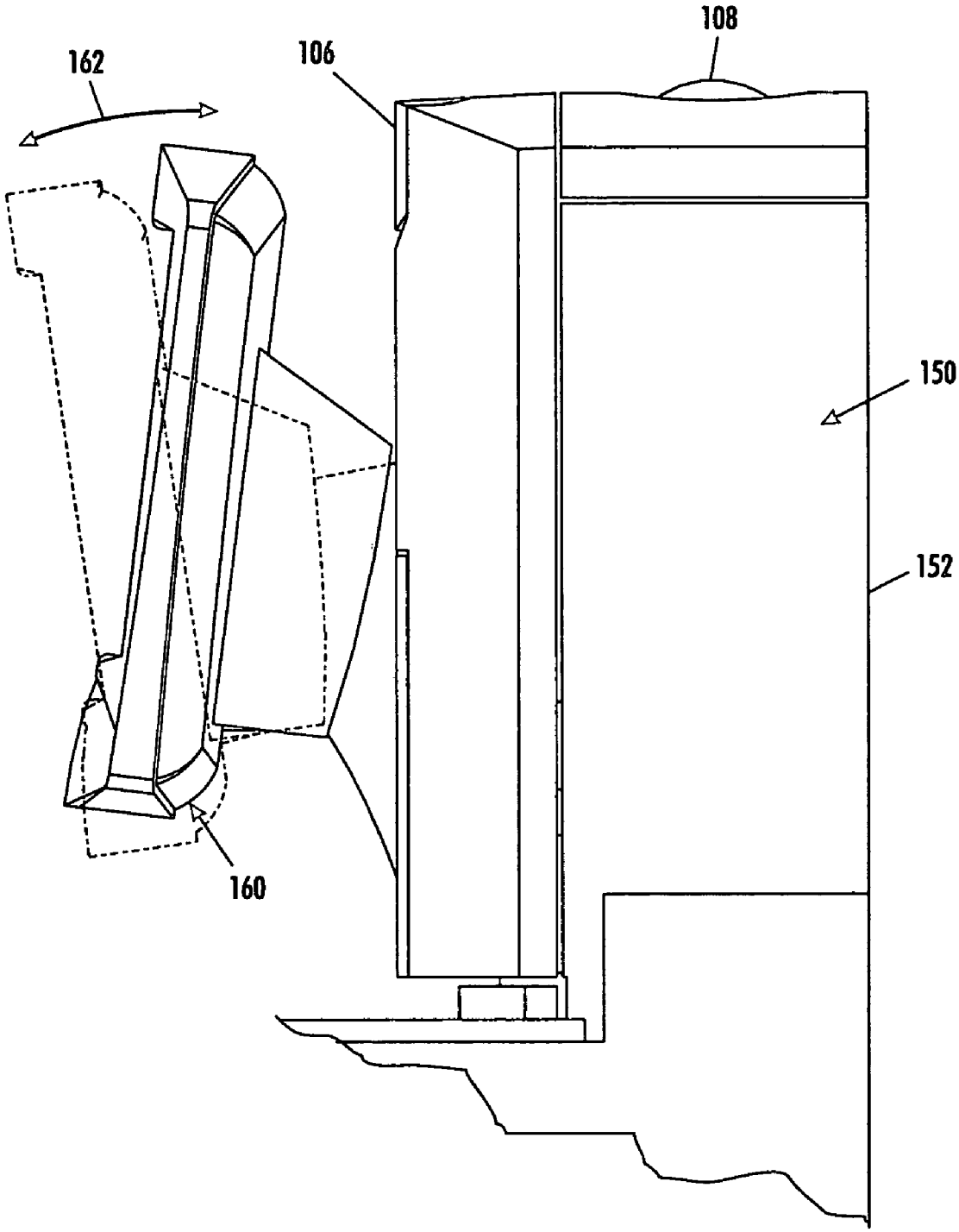
FIG. 6 is a schematic right side view of the footprint-reducing tower of the present disclosure showing up and down pivoting of the attached UI device.
Figure 7:
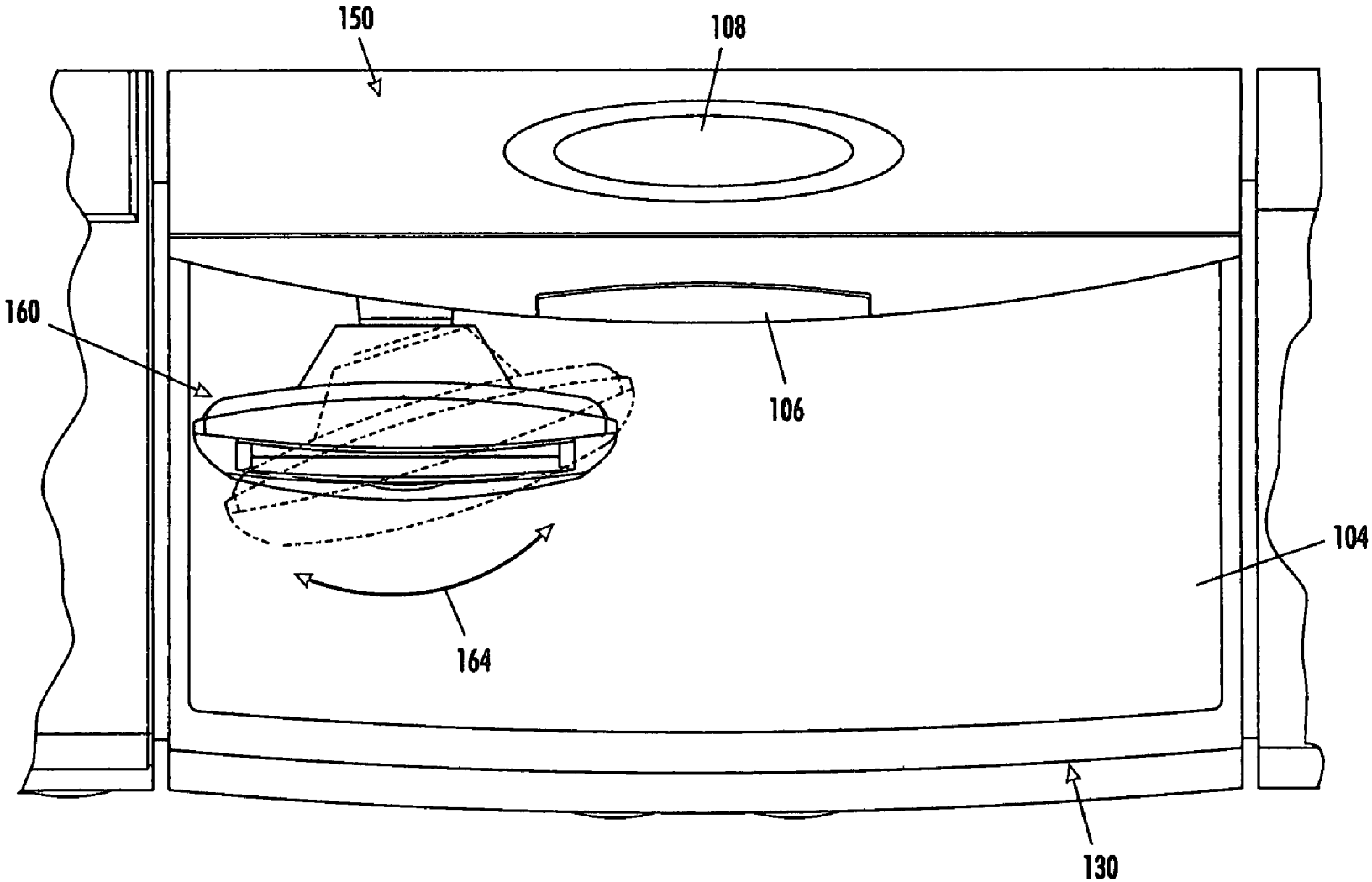
FIG. 7 is a schematic top view of the footprint-reducing tower of the present disclosure showing left and right pivoting of the attached UI device.

Referring now to FIGS. 5-7, further details of the footprint-reducing tower 150 are shown. The frame or housing 152 of the footprint-reducing tower 150 is additionally made strong enough for supporting a mounted User Interface device 160. As shown in FIG. 7, mounting the UI device 160 to vertical of the frame or housing 152 functions to free up significant work surface area 104 on the top of the IOT 130. The frame or housing 152 is also used to carry an audible speaker assembly 106 as well as the machine's warning light 108.

Compared to the prior art (FIG. 1A), all of the above electronics and contents of the footprint-reducing tower 150 as described above are relatively easier to access by either a user or a technician by virtue of the fact that they are on the top of the machine and not located in the back of the machine near to the floor. The tower 150 as mounted uses vertical space above the IOT 130 in order to save machine footprint and without interfering with the valuable work surface area real-estate 104 on the top-front of the IOT 130. The tower 150 as such does so without giving the impression of being large. On the contrary, by visually being a backdrop for the machine, it gives the impression of the machine being small, thus bringing the apparent back of the machine forward. It also uses space for functions that are not usually needed by people with disabilities, so the space might otherwise be wasted for concern with 508 requirements.

As can be seen, there has been provided a reduced footprint image producing machine including (a) an image output terminal (IOT) having (i) a moveable imaging member including an imaging surface; (ii) latent imaging devices for forming a latent electrostatic toner image on the imaging surface; (iii) a development unit for developing the latent electrostatic image on the imaging surface into a toner image; (iv) a transfer station for transferring the toner image from the imaging surface onto a toner image carrying sheet; (v) a fusing apparatus for heating and fusing the transferred image onto the toner image carrying sheet; and (b) a footprint-reducing tower mounted on top of the IOT and containing (i) machine electronics and controller assembly, and (ii) machine environment conditioning devices including cleaning and exhaust fans along with portions of associated manifolds, thereby preventing the addition of protrusions to a rear of the IOT, and thus reducing the installed foot print of the machine.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A reduced footprint image producing machine comprising;

(a) an image output terminal (IOT) including (i) a moveable imaging member including an imaging surface; (ii) latent imaging means for forming a latent electrostatic toner image on said imaging surface of said moveable imaging member; (iii) a development unit for developing said latent electrostatic image on said imaging surface into a toner image; (iv) a transfer station for transferring said toner image from said imaging surface onto a toner image carrying sheet; (v) a fusing apparatus for heating and fusing the transferred image onto the toner image carrying sheet; and (b) a footprint-reducing tower mounted on top of said IOT and containing (i) machine electronics and controller assembly including an electronic board card cage, and (ii) machine environment conditioning devices including cleaning and exhaust fans along with portions of associated manifolds, thereby preventing the addition of protrusions to a rear of said IOT, and thus reducing the installed foot print of the machine.

2. The reduced footprint image producing machine of claim 1, wherein said footprint-reducing tower supports an attached user interface device for the machine.

3. The reduced footprint image producing machine of claim 1, wherein said footprint-reducing tower carries an audible speaker assembly.

4. The reduced footprint image producing machine of claim 1, wherein said footprint-reducing tower carries a machine's warning light.

5. The reduced footprint image producing machine of claim 1, wherein said machine electronics and controller assembly includes a power supply unit.

6. The reduced footprint image producing machine of claim 1, wherein said machine electronics and controller assembly includes a controller hard drive.

7. The reduced footprint image producing machine of claim 1, wherein said machine electronics and controller assembly includes an electrical connecting grid.

8. The reduced footprint image producing machine of claim 1, wherein said machine environment conditioning devices include portions of conduits connecting said cleaning and exhaust fans to dirt pick up locations within said IOT.

9. The reduced footprint image producing machine of claim 1, wherein said machine environment conditioning devices include replaceable filters located conveniently within said footprint-reducing tower for access and service.

10. The reduced footprint image producing machine of claim 1, wherein said footprint-reducing tower includes a pair of service access doors located conveniently at a service height.

11. The reduced footprint image producing machine of claim 2, wherein said attached user interface device pivots up and down.

12. The reduced footprint image producing machine of claim 5, including a floor standing media holding and supply module for holding and supplying copy sheets to said IOT.

13. The reduced footprint image producing machine of claim 5, including a floor standing finishing module.

14. The reduced footprint image producing machine of claim 1, wherein said cleaning and exhaust fans are built into said card cage.

* * * * *